United States Patent [19]

Rodriguez

[11] 4,053,306

[45] Oct. 11, 1977

[54] TUNGSTEN CARBIDE-STEEL ALLOY

[75] Inventor: Ralph V. Rodriguez, Houston, Tex.

[73] Assignee: Reed Tool Company, Houston, Tex.

[21] Appl. No.: 661,897

[22] Filed: Feb. 27, 1976

[51] Int. Cl.[2] ..... C22C 1/10

[52] U.S. Cl. ..... 75/123 J; 75/129; 148/31

[58] Field of Search ..... 29/182.8; 75/129, 122, 75/126 C, 126 R, 123 J, 123 R, 128 W, 128 R, 130.5

[56] References Cited

U.S. PATENT DOCUMENTS

| | | | |
|---|---|---|---|
| 3,819,364 | 6/1974 | Frehn | 75/126 R X |
| 3,823,030 | 7/1974 | Hudson | 75/126 R X |
| 3,916,497 | 11/1975 | Doi et al. | 75/122 X |
| 3,917,463 | 11/1975 | Doi et al. | 75/122 X |
| 3,929,471 | 12/1975 | Akahori et al. | 75/126 C X |
| 3,942,954 | 3/1976 | Frehn | 75/128 W X |

FOREIGN PATENT DOCUMENTS

| | | | |
|---|---|---|---|
| 203,819 | 6/1955 | Australia | 29/182.8 |
| 2,426,414 | 12/1974 | Germany | 75/128 W |

*Primary Examiner*—Arthur J. Steiner
*Attorney, Agent, or Firm*—Neal J. Mosely

[57] ABSTRACT

A wear resistant hard metal composition or alloy, comprises 1 - 20 micron particles of tungsten carbide or tungsten carbide and up to about ten percent cobalt or nickel embedded uniformly throughout a steel matrix of high tungsten content. The method of making the alloy composition comprises depositing tungsten carbide particles of less than 325 mesh into a fused steel matrix.

2 Claims, No Drawings

TUNGSTEN CARBIDE-STEEL ALLOY

BACKGROUND OF THE INVENTION

1. Field of the Invention

This invention relates to new and useful improvements in hard metal alloy compositions which may be used to coat rock drill bits, tool joints and the like, or metal bearings for protection against excessive wear and characterized by uniform hardness and low abrasiveness.

2. Brief Discussion of the Prior Art

For many years, tool joints used in the well drilling industry have been protected from excessive wear on their exterior surface by application of a band of hard metal thereon. It has been known that coarse-grained hard metal such as sintered tungsten carbide may be used and will provide a greater resistance to wear but may result in wear of the interior of the well casing. The wear from coarse-grained, sintered carbide particles has been blamed for expensive fishing jobs and junked holes. Other well tools, such as stabilizers, drill collars and connectors have had hard metal applied thereto and when used within well casing may cause accelerated wear on the casing.

SUMMARY OF THE INVENTION

The subject invention comprises an improved hard metal alloy composition comprising 325 mesh, or smaller, particles of tungsten carbide or a mixture thereof with a small amount of cobalt and/or nickel uniformly dispersed in a high tungsten steel. The fine carbide particles are uniformly dispersed in the high tungsten steel which provides a more uniformly hard surface which is more easily and inexpensively manufactured and applied and provides high resistance to wear and relatively low abrasion.

OBJECTS AND FEATURES OF THE INVENTION

An object of the subject invention is to provide an improved hard metal alloy composition which is resistant to wear, has uniform hardness, and low abrasiveness.

A feature of this invention is the provision of an improved hard metal alloy composition comprising a high tungsten steel having uniformly dispersed therein extremely fine particles of tungsten carbide, or mixture of tungsten carbide and cobalt and/or nickel, characterized by uniformity of distribution of the fine tungsten carbide particles and greater uniformity of hardness.

Another feature of this invention is the provision of an improved method for preparing a hard metal alloy composition in which 325 mesh, or smaller, particles of tungsten carbide or mixture thereof with a small amount of cobalt and/or nickel are added as pressed granules and melted into a molten steel, as by welding.

Other objects and features of this invention will become apparent from time to time throughout the specification and claims as hereinafter related.

DESCRIPTION OF A PREFERRED EMBODIMENT

The improved hard metal alloy composition comprises finely milled hard metal, e.g. less than 325 mesh, deposited into molten steel. The hard metal particles are added as pressed granules and uniformly dispersed within the steel, thus providing a more uniform hard metal alloy composition of tungsten carbide particles supported in a high tungsten alloy steel matrix. Since the use of pressed granules of 325 mesh, or smaller, tungsten carbide is essential to the subject invention, a more thorough description will be given of this material and its method of manufacture and use.

In the standard sintering process for tungsten carbide a binder metal such as cobalt and/or nickel is used to bond the tungsten carbide articles together. The processing steps involve an extensive wet ballmilling using a high boiling organic solvent as the liquid medium in which the tungsten carbide and cobalt or nickel powders are thoroughly intermingled and comminuted to a fine size. Next, a small amount of wax is added as a temporary binder. The mixture is then pressed under high pressure to the desired shape or ingot is then heated under vacuum or in an inert atmosphere, such as hydrogen or nitrogen, to a temperature of about 500° C to evaporate the wax. The product is then heated again in a furnace under a protective atmosphere to a temperature of about 1500° C to fuse the binder metal and sinter the product to its final hard, dense form. It is also possible to form articles in a single step which combines the pressing and sintering operation into a single hot pressing step.

In preparing the pressed tungsten carbide particles used herein, the processing is similar to the preparation of sintered tungsten carbide but eliminates at least the final sintering step (and sometimes the dewaxing step) and may substitute a pre-sintering operation which does not involve the fusion of the binder metal or the heating of the tungsten carbide to a sintering temperature where a carbide is processed without a binder metal. In a preferred process for preparing granules of pre-sintered tungsten carbide-cobalt mixtures, the following procedure is used. About five kilograms of a 90 – 10 mixture of tungsten carbide and cobalt is wet ballmilled in a mixture with 1800 cc. of trichloroethylene. The milling operation is carried out in a mill containing 5 kg. stainless steel jar and 13 kg.of sintered tungsten carbide balls for media. The milling operation is carried out for about seven hours, stopped, about 76g. wax added, and then milled for an additional hour. The material is screened and the milled product passed through a 325 mesh (U.S. Std.) screen and oven dried. The material is further pulverized in two passes through a pulverizer and then pressed into ingots under a pressure of about 9000 p.s.i. the pressed ingots are next passed through a granulator to reduce the material to small granules having a screen size of about 14 — 39 (will pass a No. 14 screen and be retained on a No. 30 screen). The granules are then loaded in graphite boats and heated to a temperatureof 350° – 600° C under vacuum or inert atosphere. This heating is carried out for the purpose of dewaxing or removing the paraffin and pre-sintering to add green strength to the granules. A final sintering at 1500° C is not required in preparing the pre-sintered material. the granules are coarse-grained (as defined by the screen sizes above) and contain individual tungsten carbide particles of a size less than 325 mesh and preferably 10 – 20 microns.

In another process for preparing granules of tungsten carbide or tungsten carbide - cobalt (and/or nickel) mixtures, the following procedure is used. About 5 kilograms of tungsten carbide or a mixture of tungsten carbide and up to 10% cobalt or nickel is wet ballmilled in a mixture with 1800cc. of trichloroethylene. The milling operation is carried out in a mill containing 5 kg. stainless steel jar and 13 kg. of sintered tungsten carbide balls for media. The milling operation is carried out for about seven hours, stopped, about 75g. wax added, and then milled for an additional hour. The material is screened and the milled product passed through a 325 mesh (U.s. Std.) screen and oven dried. The material is further pulverized in two passes through a pulverizer and then pressed into ingots under a pressure of about 9000 p.s.i. The pressed ingots are next passed through a granulator to reduce the material to small granules having a screen size of about 14 - 30 (will pass a No. 14 screen and be retained on a No. 30 screen). The granules are bound by the wax and are coarse-grained (as defined by the screen sizes above). These granules contain individual tungsten carbide particles of a size less than 325 mesh and preferably 10 - 20 microns.

In applying the tungsten carbide granules to the manufacture of hard metal alloy compositions, a variety of methods have been used. The granules have been applied by atomic hydrogen welding, oxy-acetylene welding, gaseous tungsten arc welding, and plasma welding, both with and without an additional welding flux. The granules may be applied uniformly to the surface of a steel article and dispersed into molten metal which is formed in the welding process of the steel article itself or into molten steel which may be applied from a welding electrode.

When the granules are introduced into the molten steel, the particles of tungsten carbide are dispersed and in the case of the wax-bound granules, the wax is flashed off. The fine (smaller than 325 mesh) particles of tungsten carbide partially dissolve in and alloy with the molten steel forming a high tungsten alloy steel (which may contain nickel or cobalt) matrix in which there is left a residue of uniformly dispersed extremely small (circa. 1 - 20 microns) tungsten carbide articles. The dispersion of tungsten carbide particles in the resulting high tungten alloy steel is of a high hardness (in excess of Rockwell C 55) which is uniform over the surface of the article. The tungsten carbide is added to the steel in the amount of 50 - 250 parts by weight to 100 parts by weight of the steel. The addition of 120 parts tungsten carbide to 100 parts of a fused 1010 steel has produced a high tungsten alloy steel containing uniformly dispersed tungsten carbide particles. This material has a Rockwell C hardness of 61 - 69 and is smooth and non-abrasive.

The improved hard metal alloy composition may be deposited on the surface layer of a tubular tool joint or drill collar, or on a rock bit or a bearing and is characterized by being virtually free of porosity, having a uniform dispersion of tungsten carbide within the deposit, and having a uniform hardness rather than a substantial variation in hardness as occurs when sintered tungsten carbide articles are embedded in a steel matrix. In coating tubular steel products such as tool joints with this material, the time of application was substantially shorter than is required in the appication of sintered carbide. In fact, there was a time saving of about five minutes per application. The hardness is more uniform and higher than is normally obtained with standard sintered carbide pellets. The average Rockwell C hardness is about 65 as compared to a Rockwell C hardness of 40 for the steel matrix and 64 for the sintered articles for hard banding using standard sintered carbide pellets. There is a sound metallurgical bond of the coating to the steel substrate which insures that the coating is tough and has excellent wear resistance. The dispersion of the very fine (less than 325 mesh) tungsten carbide particles from the pressed granules throughout the high tungsten steel alloy results in an extremely uniform hardness in the deposit as compared to a difference in hardness of about 15 Rockwell C units between the steel matrix and tungsten carbide pellets in compositions using standard sintered carbide particles. The uniform hardness results from the tungsten and carbon-rich steel alloy which contains 1 - 20 micron size particles of tungsten carbide dispersed uniformly therein. The uniform hardness and higher hardness and greater toughness has been found to be obtained only when the pressed, unsintered granules are used. A similar effect has not been obtained with sintered tungsten carbide particles and finely milled particles (less than 325 mesh) of tungsten carbide or mixtures of finely milled tungsten carbide and cobalt or nickel cannot be handled and fed satisfactorily in a weldng process to produce the desired hard metal alloy composition commercially.

I claim:

1. A hard metal composition comprising 1–20 micron particles of tungsten carbide uniformly dispersed in a high tungsten alloy steel matrix and having a uniform surface hardness in excess of Rockwell C 55, obtained by addition of pressed unsintred granules of tungsten carbide particles less than 325 mesh in size to molten steel in a ratio of 50–250 parts by weight of tungsten carbide to 100 parts by weight of steel, the high tungsten alloy steel matrix being produced by in situ decomposition of the tungsten carbide added to the molten steel.

2. A hard metal composition in accordance with claim 1 in which the tungsten carbide particles in said granules contain up to ten percent (10%) cobalt or nickel.

* * * * *